US008413338B2

(12) United States Patent
Freeman

(10) Patent No.: US 8,413,338 B2
(45) Date of Patent: Apr. 9, 2013

(54) FOLDING KNIFE WITH SAFETY AND WEDGE LOCK

(75) Inventor: Jeffrey Freeman, Tigard, OR (US)

(73) Assignee: Fiskars Brands, Inc., Madison, WI (US)

( * ) Notice: Subject to any disclaimer, the term of this patent is extended or adjusted under 35 U.S.C. 154(b) by 844 days.

(21) Appl. No.: 12/502,777

(22) Filed: Jul. 14, 2009

(65) Prior Publication Data

US 2011/0010947 A1 Jan. 20, 2011

(51) Int. Cl.
*B26B 1/04* (2006.01)

(52) U.S. Cl. ..... 30/159; 30/160; 30/161

(58) Field of Classification Search ..... 30/160, 30/159, 161, 155, 158
See application file for complete search history.

(56) References Cited

U.S. PATENT DOCUMENTS

| | | | | |
|---|---|---|---|---|
| 294,558 | A | 3/1884 | Wingfield | |
| 336,314 | A | 2/1886 | Hatfield | |
| 361,315 | A | 4/1887 | Nuessle | |
| 842,173 | A | 1/1907 | Carman | |
| 1,018,210 | A | 2/1912 | Segel et al. | |
| 1,357,398 | A | 11/1920 | Haywood | |
| 1,418,683 | A | 6/1922 | Stevens | |
| 1,728,619 | A | 9/1929 | Lambert | |
| 1,931,773 | A | 10/1933 | Sobol | |
| 2,137,800 | A | 11/1938 | Davey | |
| 2,188,762 | A * | 1/1940 | Schrade | 30/160 |
| 2,421,339 | A | 5/1947 | Leger | |
| 2,520,355 | A | 8/1950 | Bell | |
| 3,266,081 | A | 8/1966 | Heim | |
| 3,315,356 | A | 4/1967 | Swanke et al. | |
| 3,418,713 | A | 12/1968 | Bauer | |
| D226,410 | S | 2/1973 | Kunze | |
| D227,071 | S | 6/1973 | Bernedotte et al. | |
| 3,750,283 | A | 8/1973 | Hoffman | |
| D230,696 | S | 3/1974 | Evrell et al. | |
| 3,839,788 | A | 10/1974 | Addis | |
| 3,872,572 | A | 3/1975 | Hahn | |
| 3,942,249 | A | 3/1976 | Poehlmann | |
| 3,943,934 | A | 3/1976 | Bent | |
| 3,977,079 | A | 8/1976 | Rebold | |
| 4,011,657 | A | 3/1977 | Vance | |
| 4,028,806 | A | 6/1977 | Sheldon | |

(Continued)

OTHER PUBLICATIONS

Pacific Knife, available at least as early as Sep. 2006, 1 page, Chris Reeve Knives®.

(Continued)

*Primary Examiner* — Stephen Choi
(74) *Attorney, Agent, or Firm* — Foley & Lardner LLP

(57) ABSTRACT

A folding knife includes a handle, an axle coupled to a first end of the handle, and a blade rotatably coupled to the axle. The blade includes a working portion and a tang, the blade having an open position in which the working portion extends from the handle and a closed position in which the working portion is substantially received within the handle. The folding knife further includes a lock having a locked position in which the lock prevents rotation of the blade and an unlocked position in which the lock permits rotation of the blade. The knife further includes a spring arm in the handle and a safety coupled to the handle, the safety having a first position in which the safety deflects the spring arm into the path of the lock to maintain the lock in the locked position and a second position in which the safety permits the lock to move from the locked position to the unlocked position.

21 Claims, 9 Drawing Sheets

U.S. PATENT DOCUMENTS 4,068,375 A 1/1978 Rathbun et al.
4,133,106 A 1/1979 Addis
4,145,808 A 3/1979 Walsh
D252,182 S 6/1979 Poehlmann
4,170,061 A 10/1979 Henry
4,173,071 A 11/1979 Ishida
4,184,248 A 1/1980 Wolfe
D256,983 S 9/1980 Fogle
4,233,737 A 11/1980 Poehlmann
4,249,306 A 2/1981 Benson
4,265,017 A 5/1981 Collins
4,327,465 A 5/1982 Moritsch
4,330,937 A 5/1982 Cope
4,347,665 A 9/1982 Glesser
4,391,043 A 7/1983 Sizemore et al.
4,404,748 A 9/1983 Wiethoff
4,408,394 A 10/1983 Phelps
4,411,068 A 10/1983 Theodorides
4,452,289 A 6/1984 Smith
4,478,532 A 10/1984 Puro
4,509,260 A 4/1985 Gringer
D280,287 S 8/1985 Collins
4,535,539 A 8/1985 Friedman et al.
4,570,341 A 2/1986 Konneker
4,578,864 A 4/1986 Hoffman
4,670,984 A 6/1987 Rickard
4,716,653 A 1/1988 Skyba
4,757,612 A 7/1988 Peyrot
4,761,882 A 8/1988 Silverstein
D298,211 S 10/1988 Coburn
D299,413 S 1/1989 DeCarolis
4,805,303 A 2/1989 Gibbs
4,817,284 A 4/1989 Sacherman et al.
4,825,552 A 5/1989 Bendickson et al.
D302,649 S 8/1989 Porsche et al.
D302,934 S 8/1989 Finn
D304,154 S 10/1989 Osterhout
D306,817 S 3/1990 McMorrough
D307,383 S 4/1990 Huang
4,918,820 A 4/1990 Korb et al.
D307,702 S 5/1990 Hsu
4,947,552 A 8/1990 Barnes
4,949,457 A 8/1990 Burout, III
4,985,998 A 1/1991 Howard
4,989,320 A 2/1991 Borkott et al.
5,025,557 A 6/1991 Perreault
D317,847 S 7/1991 Loveless
5,060,379 A 10/1991 Neely
D321,820 S 11/1991 Russell
5,093,995 A 3/1992 Jan
5,111,581 A 5/1992 Collins
5,131,149 A 7/1992 Thompson et al.
D332,383 S 1/1993 Hagler et al.
5,250,063 A 10/1993 Abidin et al.
5,283,954 A 2/1994 Szabo
D345,289 S 3/1994 Sakai
5,303,474 A 4/1994 Keklak et al.
D347,375 S 5/1994 Sakai
D348,818 S 7/1994 Hasegawa
D351,328 S 10/1994 Hasegawa
5,400,509 A 3/1995 Collins
D357,166 S 4/1995 Concari
D361,254 S 8/1995 Silberstein
D366,408 S 1/1996 Sessions et al.
5,511,310 A 4/1996 Sessions et al.
D371,289 S 7/1996 Huang
5,553,386 A 9/1996 Hsu
5,581,893 A 12/1996 Ouellette
5,596,808 A * 1/1997 Lake et al. ..... 30/161
D384,871 S 10/1997 McWillis
D389,718 S 1/1998 Wegner
5,729,904 A 3/1998 Trott
5,822,866 A * 10/1998 Pardue ..... 30/161
D407,004 S 3/1999 Hull et al.
5,878,500 A 3/1999 Emerson
D407,961 S 4/1999 Balolia
D412,275 S 7/1999 Collins
5,926,959 A 7/1999 Collins
D413,503 S 9/1999 Dugdale
D428,789 S 8/2000 McHenry et al.
6,131,292 A 10/2000 Reddig
D433,913 S 11/2000 Pardue
6,148,522 A 11/2000 Dobandi
D435,400 S 12/2000 Veltz et al.
D438,443 S 3/2001 Keating
D442,461 S 5/2001 Glesser
6,260,281 B1 7/2001 Okumura et al.
6,263,581 B1 7/2001 Forte
6,289,592 B1 9/2001 Emerson
6,308,418 B1 10/2001 Sweet
6,330,749 B1 12/2001 Khachatoorian et al.
6,367,154 B2 4/2002 Degabli
D461,387 S 8/2002 Glesser
D473,917 S 4/2003 Carter, III
D478,493 S 8/2003 Martone et al.
6,638,290 B2 10/2003 Pascaloff et al.
6,763,747 B1 7/2004 Gierer et al.
D528,895 S 9/2006 Ping
7,174,590 B1 2/2007 Quenzi
D541,128 S 4/2007 Farland
7,234,241 B2 6/2007 Chu
D553,468 S 10/2007 Freeman
D560,998 S 2/2008 Farland
D561,554 S 2/2008 Taylor
D581,241 S 11/2008 Freeman
D582,243 S 12/2008 Freeman et al.
D582,747 S 12/2008 Freeman et al.
2003/0079353 A1 5/2003 Lovell et al.
2004/0154170 A1* 8/2004 Kain et al. ..... 30/161
2004/0158991 A1 8/2004 Freeman
2005/0132576 A1 6/2005 Onion
2005/0252010 A1 11/2005 Freeman
2006/0080840 A1 4/2006 Freeman
2006/0260137 A1* 11/2006 Flagg et al. ..... 30/160
2007/0227012 A1 10/2007 Constantine et al.
2008/0201953 A1* 8/2008 Bremer et al. ..... 30/1
2009/0193664 A1* 8/2009 Galyean ..... 30/161

OTHER PUBLICATIONS

Photograph of Prototype of Pacific Knife, available at least as early as Sep. 2006, 1 page.
Santiam™ II Fine Edge Knife, available at least as early as 2006, 1 page.
Gerber Custom Series Knives, Gerber Legendary Blades, available at least as early as 1977, 1 page.
Photographs of knife handles, available at least as early as Jul. 26, 2006, 2 pages.
Smokey Mountain knife works catalog, 2003, pp. 9, 20, 21, 22, 23, 46, 47, 48, 64, 65.
Knife Center website, Gerber folding knives, available at least as early as May 15, 2007, 3 pages.
Knife Center website, Automatic opening knives, available at least as early as May 15, 2007, 2 pages.
Gator® Exchange-A-Blade™ Saw, Product No. 6047, believed to have been available prior to May 17, 2004, 1 page.
Katz Knives, Inc., Symbol of Quality Knives, Katz Knives Catalog, 2003, 2 pages.
Bladetraders, printed from website www.kershawknives.com on Mar. 18, 2004, 2 pages.
Safari Kit, printed from website www.katzknives.com on Mar. 18, 2004, 3 pages.
Bolt-Action Knives, Gerber Legendary Blades Catalog, 1994, 1 page.
Notice of Allowance for U.S. Appl. No. 29/316,495, mail date Feb. 4, 2010, 6 pages.

* cited by examiner

FOLDING KNIFE WITH SAFETY AND WEDGE LOCK

BACKGROUND

The present application relates to a folding knife. In particular, the present application relates to an automatic knife having a lock configured to lock the knife blade in both the closed and the open positions and a safety mechanism configured to prevent inadvertent rotation of the knife blade out of either the closed or the open position.

Folding knives typically include a handle and one or more blades pivotally attached to the handle, the blades having a compact closed position and an extended open position. Folding knives may be manually operated, have an assisted-opening mechanism, or have an automatic opening mechanism for moving the blade from the closed into the open position.

In folding knives having a manual operation, a user opens the blade by grasping the blade or pushing a knob protruding from the blade in order to rotate the blade into the open position. Assisted-opening knives include a bias mechanism that aids the user in opening the blade, typically requiring the user to open the blade a certain amount manually, then assisting the opening of the blade the rest of the way into the open position. Automatic knives include a bias mechanism configured to fully open the blade upon actuation of an opening mechanism, such as a push-button. A folding knife may have a locking mechanism configured to lock the blade into one or both of the closed or open positions. A number of locking mechanisms are known including liner locks having a spring arm that engages the rear of the blade to lock the blade open and other sliding or push-button mechanisms that engage the blade to prevent blade rotation.

In more sophisticated folding knives, a safety may be included to maintain the blade in the closed position. Such a safety may be particularly desirable in the case of an automatic knife to ensure that the blade is not inadvertently opened.

SUMMARY

A folding knife includes a handle, an axle coupled to a first end of the handle, and a blade rotatably coupled to the axle. The blade includes a working portion and a tang, the blade having an open position in which the working portion extends from the handle and a closed position in which the working portion is substantially received within the handle. The folding knife further includes a lock having a locked position in which the lock prevents rotation of the blade and an unlocked position in which the lock permits rotation of the blade. The folding knife further includes a spring arm in the handle and a safety coupled to the handle, the safety having a first position in which the safety deflects the spring arm into the path of the lock to maintain the lock in the locked position and a second position in which the safety permits the lock to move from the locked position to the unlocked position.

The invention further relates to an automatic knife including a handle, an axle coupled to a first end of the handle, and a blade rotatably coupled to the axle. The blade includes a working portion and a tang, the blade having an open position in which the working portion extends from the handle and a closed position in which the working portion is substantially received within the handle. The automatic knife further includes a spring operating on the blade to bias the blade into the open position and a lock having a locked position in which the lock prevents rotation of the blade and an unlocked position in which the lock permits rotation of the blade, and a spring arm in the handle. The folding knife further includes a safety coupled to the handle, the safety having a first position in which the safety deflects the spring arm into the path of the lock to maintain the lock in the locked position and a second position in which the safety permits the lock to move from the locked position to the unlocked position. When the lock is in the unlocked position, the spring rotates the blade from the closed into the open position.

The invention further relates to a safety mechanism for a folding knife having a blade, a handle, a liner, and a blade lock. The safety mechanism includes a base configured to slide with respect to the handle, a user interface on a side of the base, a first projection extending from the base into the plane of the liner, and a spring arm incorporated into the liner. The first projection interfaces with the spring arm to force the spring arm into a position in which the spring arm prevents movement of the blade lock relative to the handle.

The invention is capable of other embodiments and of being practiced or being carried out in various ways. Alternative exemplary embodiments relating to other features and combinations of features as may be generally recited in the claims.

BRIEF DESCRIPTION OF THE FIGURES

The invention will become more fully understood from the following detailed description, taken in conjunction with the accompanying drawings, wherein like reference numerals refer to like elements, in which.

DESCRIPTION OF THE EXEMPLARY EMBODIMENTS

Before turning to the figures, which illustrate the exemplary embodiments in detail, it should be understood that the application is not limited to the details set forth in the following description or illustrated in the figures. It should also be understood that the terminology is for the purpose of description only and should not be regarded as limiting.

Figure 1:
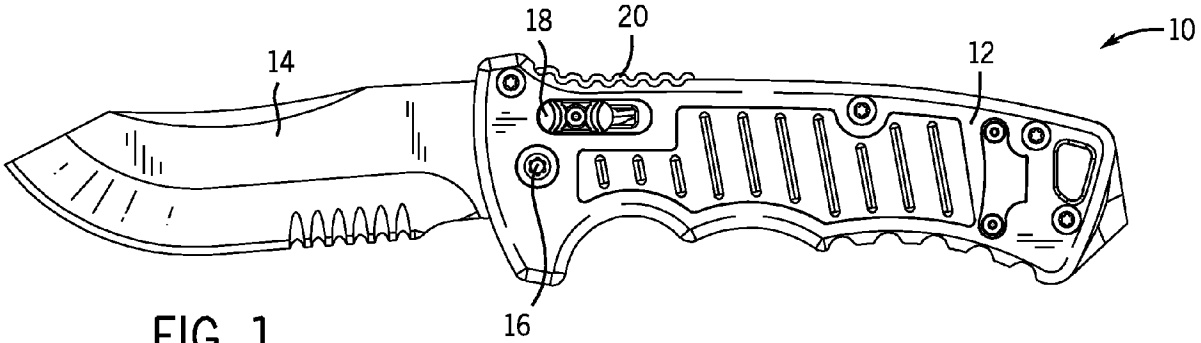
FIG. 1 is a side view of a folding knife with the blade in the open position according to an exemplary embodiment.

Referring to FIG. 1, a knife according to an exemplary embodiment is shown as folding knife 10 with a handle 12 and a blade 14 pivotally coupled to the handle 12. The blade 14 has an extended open position and a compact closed position. The blade 14 is pivotally coupled to the handle 12 by an axle 16 extending through the blade 14.

Further referring to FIG. 1, in a exemplary embodiment, the folding knife 10 is an automatic knife such that the blade 14 may be automatically opened by sliding a lock button 18 to unlock the blade 14. A safety 20 prevents unintended actuation of the automatic opening mechanism.

Figure 2:
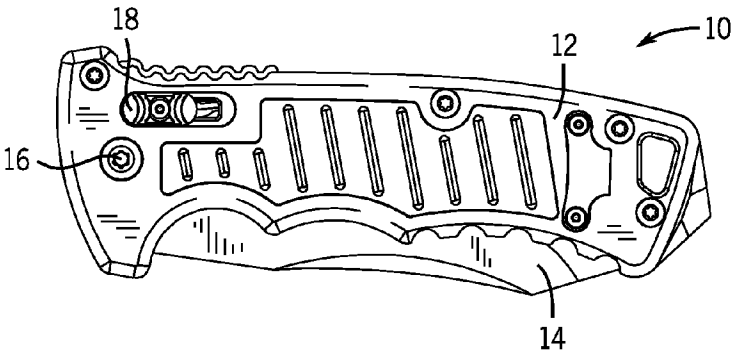
FIG. 2 is a side view of the folding knife of FIG. 1 with the blade in the closed position.

Referring to FIG. 2, the blade 14 is shown in the closed, compact configuration within the handle 12. The blade 14 is maintained in the closed position by a lock mechanism operated via lock button 18.

Figure 3:
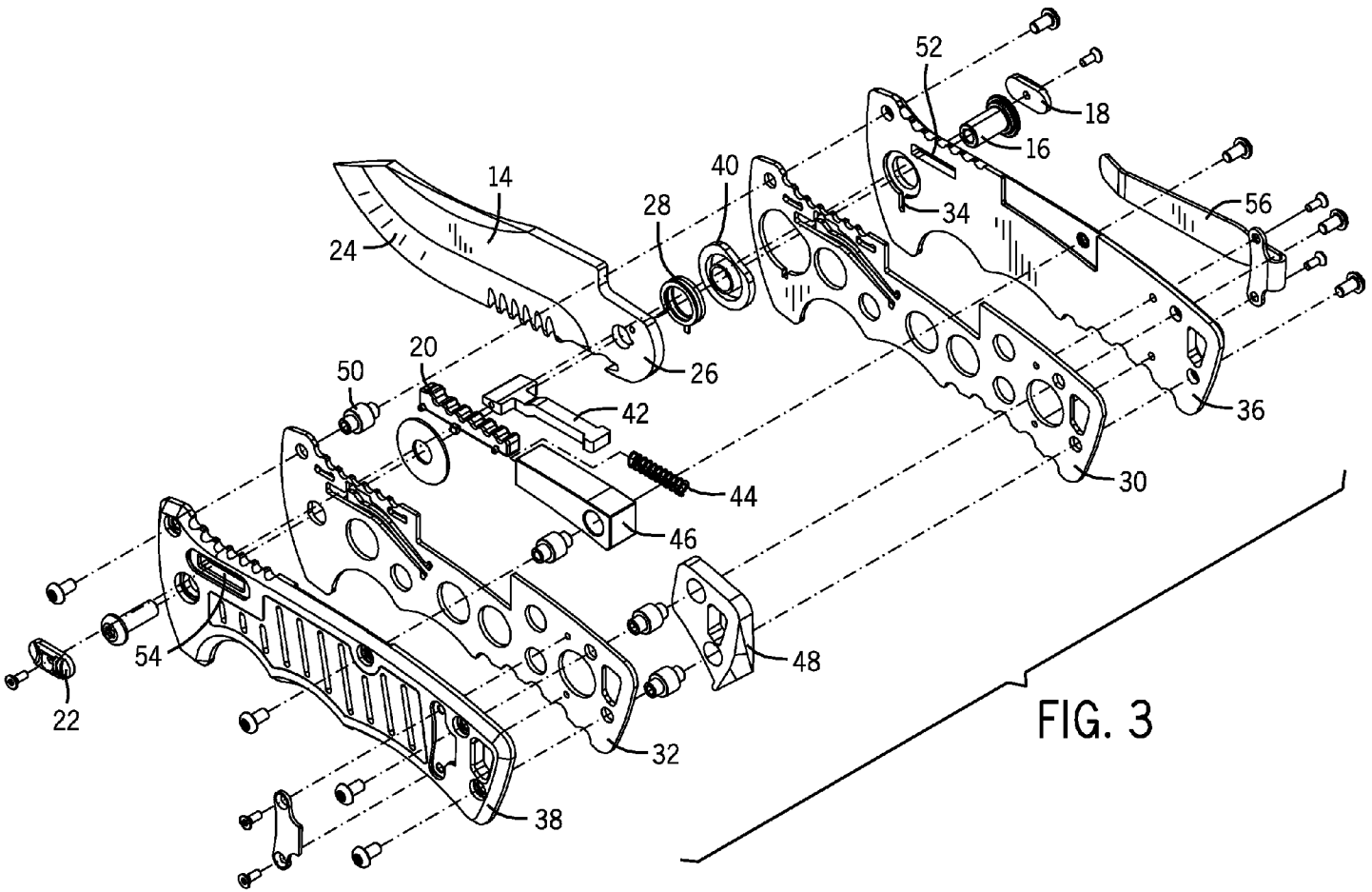
FIG. 3 is an exploded isometric view of a folding knife according to an exemplary embodiment.

Referring to FIG. 3, according to an exemplary embodiment, the blade 14 includes a working portion 24 and a tang 26. The tang 26 is rotatably coupled to an axle 16 that extends through the handle 12. In the automatic knife embodiment shown in FIG. 3, a blade spring 28 is used to bias the blade 14 into the open position. One end of the blade spring 28 is received within an aperture in the tang 26 and another end of the blade spring 28 is coupled to side scale 36 via a notch 34. A spring housing 40 maintains the blade spring 28 in its proper position after assembly. A lock mechanism includes a wedge 42 that is biased toward the tang 26 by a spring 44 that is received in a spring retainer 46 between a pair of liners 30, 32. A safety 20 is positioned near the front of the handle 12 and a butt cap 48 is positioned at the rear of the handle 12. A blade stop 50 is attached to the handle 12 and stops the blade 14 from rotating when the blade 14 has achieved the fully open position. Outside of the liners 30, 32 are side scales or handle scales 36, 38 that include recesses to maintain the position of other components and slots 52, 54 to permit sides of the wedge 42 to extend through the scale 36, 38 to be attached to lock buttons 18, 22. The lock buttons 18, 22 serve as a user interface for the lock mechanism. A clip 56 is attached to the exterior of one of the side scales 36, 38. The various materials that may be used to construct the folding knife components shown in FIG. 3 are known to those of skill in the art.

Figure 4A:
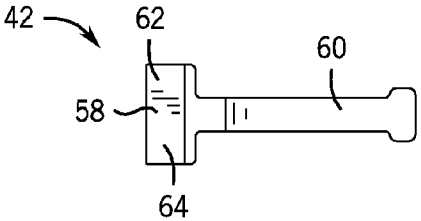
FIG. 4*a* is a top-view of a wedge for a folding knife lock mechanism according to an exemplary embodiment.
Figure 4B:
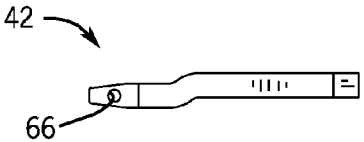
FIG. 4*b* is a side-view of a wedge for a folding knife lock mechanism according to an exemplary embodiment.

Referring to FIG. 4, a top-view of the wedge 42 is provided in FIG. 4*a*, illustrating a front portion 58 and a rear portion 60. The front portion 58 includes a pair of arms or side extensions 62, 64. FIG. 4*b* shows a side-view of the wedge 42. An aperture 66 is provided on each of the side extensions 62, 64 for attaching the lock buttons 18, 22 (see FIG. 3) with a fastener.

Figure 5:
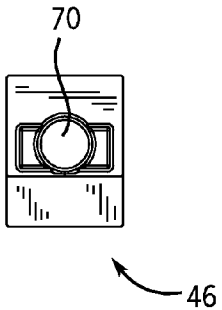
FIG. 5 is an end-view of a spring retainer for a folding knife according to an exemplary embodiment.

Referring to FIG. 5, the spring retainer 46 includes a cavity 70 sized to fit the spring 44 (see FIG. 3) used to bias the wedge 42 into the locked position.

Figure 6:
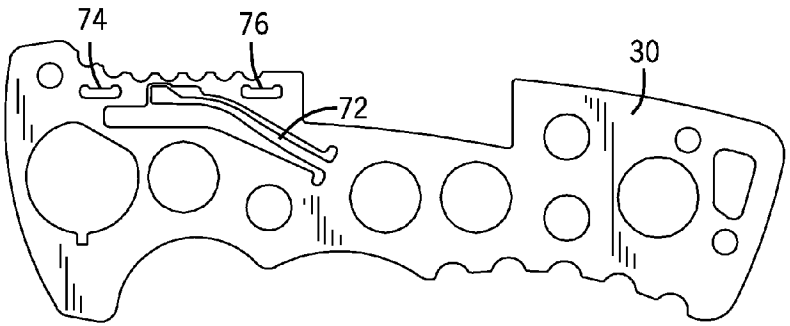
FIG. 6 is a side-view of a liner for a folding knife according to an exemplary embodiment.

Referring to FIG. 6, a side-view of liner 30 is provided to more clearly show the arrangement of the liner 30. Liner 32 is similar. A spring arm 72 forms part of a safety mechanism as will be described in more detail below. The spring arm 72 may be an integral extension from liner 30 and formed of spring steel. A pair of safety arm slots 74, 76 are formed in the liner 30, each of the safety arm slots 74, 76 including two enlarged ends that receive arms 72 extending from the safety 20 (see FIG. 7) and help maintain the safety 20 in position.

Figure 7A:
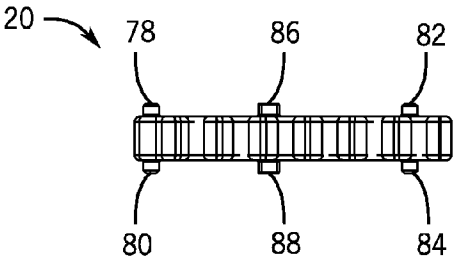
FIG. 7*a* is a top-view of a safety for a folding knife according to an exemplary embodiment.
Figure 7B:
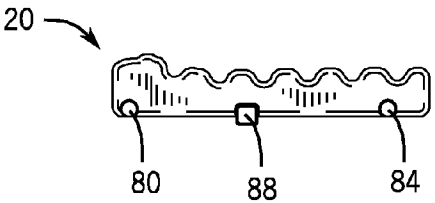
FIG. 7*b* is a side-view of a safety for a folding knife according to an exemplary embodiment.

FIG. 7*a* shows a top-view of the safety 20, including the arms 78, 80, 82, 84 that extend from each side of the base and interface with the safety arms slots 74, 76 (see FIG. 6). The top of the safety 20 is textured to provide additional grip so that the top can function as a user interface for a user of the knife 10 to engage the safety 20 with a thumb or finger to move the safety 20 back and forth between its on and off positions. Extending from each side of the safety 20 are projections, shown as spring arm interfaces 86, 88 that extend into the adjacent liners 30, 32 on each side and engage the spring arms 72 as will be described in more detail below.

Figure 8B:
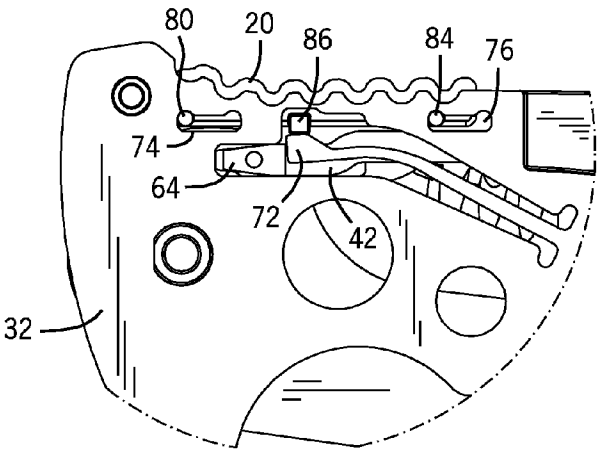
FIG. 8*b* is an enlarged view of the area indicated by line 8*b*-8*b* of FIG. 8*a;*
Figure 8A:
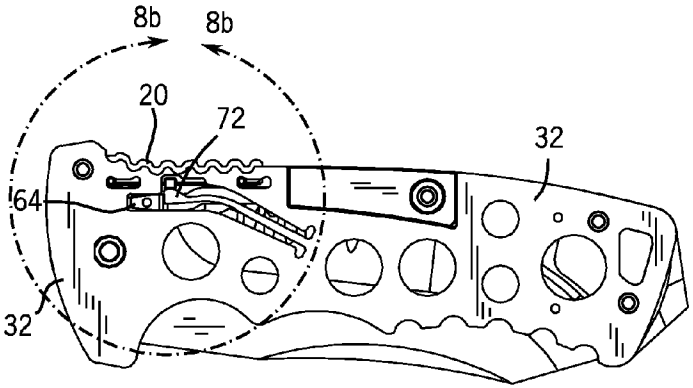
FIG. 8*a* is a side-view of a folding knife with the blade closed and locked and the safety on with the handle scale in the foreground removed according to an exemplary embodiment.
Figure 8C:
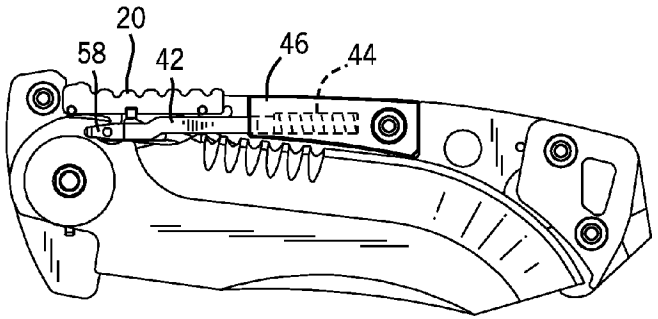
FIG. 8*c* is a side-view of the folding knife of FIG. 8*a* with the liner in the foreground removed.

Referring to FIGS. 8*a* through 8*c*, when the blade 14 is in the closed position, the wedge 42 is used to lock the blade 14 in the closed position as best shown in FIG. 8*c*. The front portion 58 of the wedge 42 is driven into a corresponding slot in the blade tang 26, preventing the blade 14 from rotating out of the closed position until the wedge 42 is removed from the slot. The spring 44 within spring retainer 46 (see FIG. 8*c*) biases the wedge 42 into the locked position. When the safety mechanism is on (i.e. preventing the wedge 42 lock from being disengaged) as shown in FIG. 8, the spring arm interface 88 pushes the spring arm 72 downward into the path of the side extension of the wedge 42 so that the lock cannot be disengaged. The spring arm interface 86 similarly engages the spring arm 72 of the other liner. Note how the arms 80, 84 of the safety 20 are received in the safety arm slots 74, 76 in the liner 32 as best shown in FIG. 8*b*. The enlarged portions at the ends of the safety arm slots 74, 76 help maintain the position of the arms 80, 84 to positively retain the safety 20 in the selected position until the user provides a force on the safety 20 to move the safety 20 out of the selected position to the other position. The arms 78, 82 on the other side of the safety 20 interface with liner 30 in a similar fashion (see FIGS. 3 and 7).

Figure 9B:
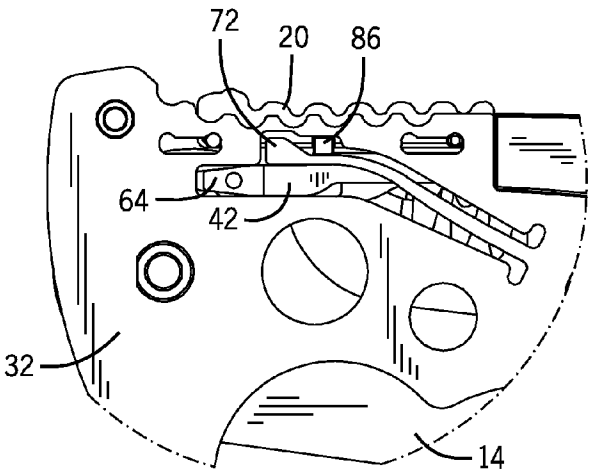
FIG. 9*b* is an enlarged view of the area indicated by line 9*b*-9*b* of FIG. 9*a;*
Figure 9A:
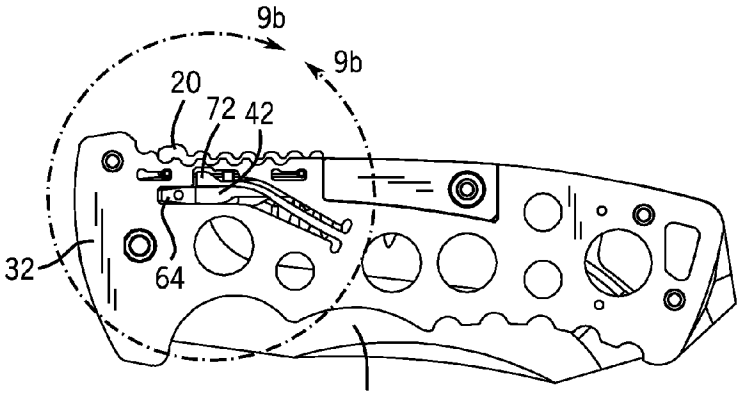
FIG. 9*a* is a side-view of a folding knife with the blade closed and locked and the safety off with the handle scale in the foreground removed according to an exemplary embodiment.
Figure 9C:
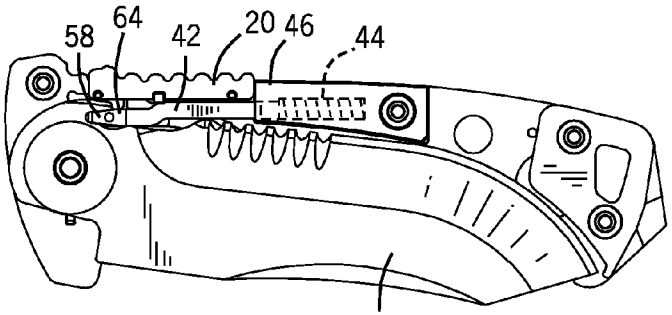
FIG. 9*c* is a side-view of the folding knife of FIG. 9*a* with the liner in the foreground removed.

Referring to FIG. 9, the folding knife is shown in a configuration with the blade 14 closed, the wedge 42 locked, but with the safety 20 off. When the safety 20 is off, the spring arm interface 86 does not push the spring arm 72 into the path of the side extension 64 of the safety 20. Instead, the spring arm 72 rests in its default position, best shown in FIG. 9*b*. As shown in FIG. 9*c*, when the safety 20 is off, the wedge 42 may still lock the blade 14 in the closed position, but a user may move the wedge 42 out of the locked position against the bias of spring 44 to open the blade 14.

Figure 10B:
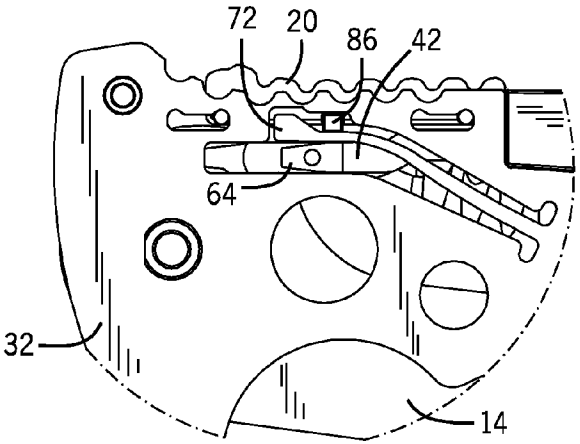
FIG. 10*b* is an enlarged view of the area indicated by line 10*b*-10*b* of FIG. 10*a;*
Figure 10A:
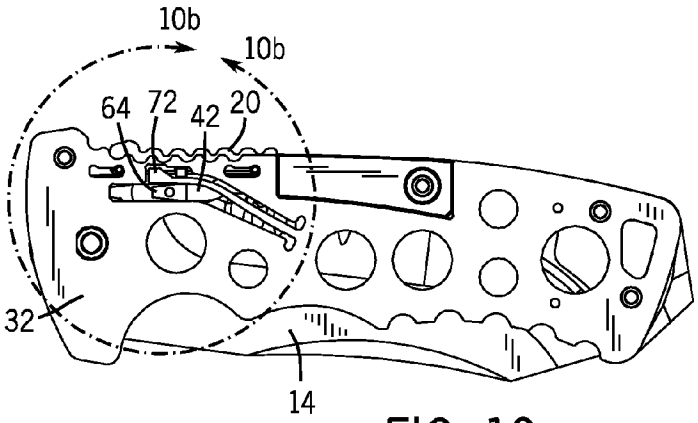
FIG. 10*a* is a side-view of a folding knife with the blade closed and unlocked with the safety off with the handle scale in the foreground removed according to an exemplary embodiment.
Figure 10C:
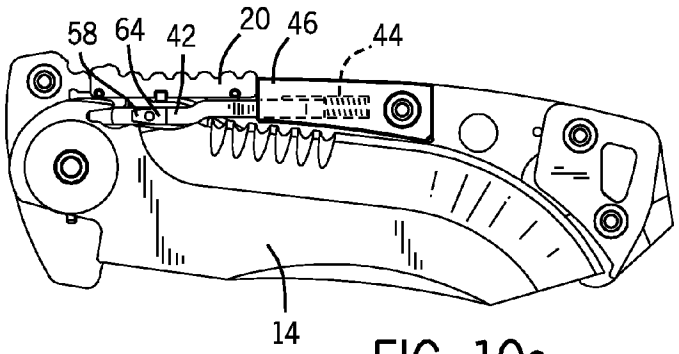
FIG. 10*c* is a side-view of the folding knife of FIG. 10*a* with the liner in the foreground removed.

Referring to FIG. 10, the knife 10 is shown with the blade 14 closed, the safety 20 off, and the wedge 42 moved out of the locked position and into the unlocked position. The wedge 42 does not stay in the unlocked position unless held in the unlocked position against the force provided by the spring 44 (shown in FIG. 10*c*). When the wedge 42 is not in the locked position, the blade 14 is free to rotate as best shown in FIG. 10*c* because the front portion 58 of the wedge 42 is no longer disposed within the corresponding slot in the tang 26 of the blade 14. Note how the side extension 62 of the wedge 42 may be moved toward the rear of the handle 12 without being blocked by the spring arm 72 due to the position of the safety 20 in the off configuration. While FIG. 10*b* shows only liner 32, a similar configuration exists in the other liner 30, as shown in FIG. 3. The configuration shown in FIG. 10 with the blade 14 free to rotate results in automatic rotation of the blade 14 into the open position in the case of a spring driven automatic knife embodiment. In other embodiments without a spring driving the blade 14, the user may manually rotate the blade 14 into the open position, or, in the case of a spring-assisted knife, the user may rotate the blade 14 a few degrees out of the handle 12 to permit a spring to open the blade 14 the rest of the way.

Figure 11A:
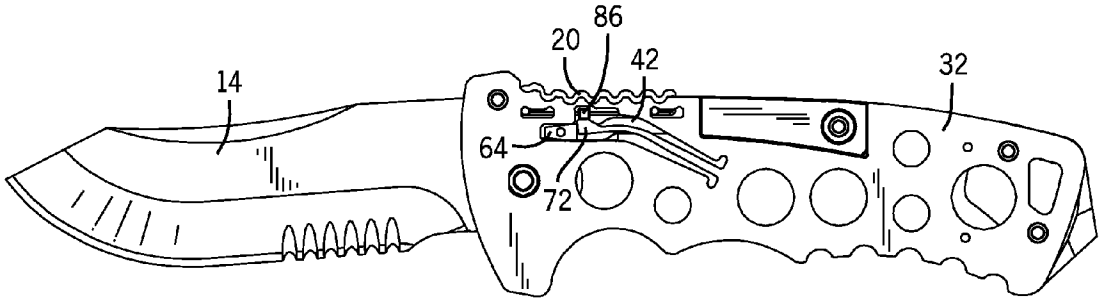
FIG. 11*a* is a side-view of a folding knife with the blade opened and locked and the safety on with the handle side in the foreground removed according to an exemplary embodiment.
Figure 11B:
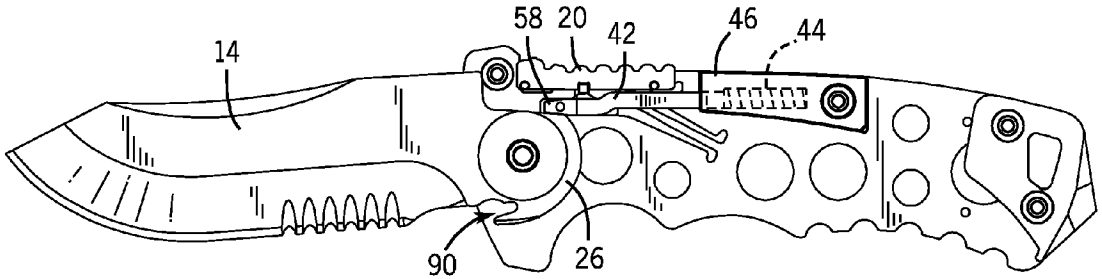
FIG. 11*b* is a side-view of the folding knife of FIG. 11*a* with the liner in the foreground removed.

Referring to FIG. 1, the blade 14 is shown in the open position with the wedge 42 locked and the safety 20 on. FIG. 11*a* shows the liner 32, demonstrating how the safety 20, via the spring arm interface 86, maintains the wedge 42 in the locked position by forcing the spring arm 72 into the path of travel of the side extension 64 of the wedge 42, similar to as described with respect to the blade closed configuration. Referring to FIG. 11*b*, the front portion 58 of the wedge 42 contacts the tang 26 of the blade 14 and interferes with counter-clockwise rotation of the blade 14 from the open into the closed position until the front portion 58 of the wedge 42 is removed from the position shown in FIG. 1. In a preferred embodiment, the wedge 42 automatically slides into the locked position, whether the blade 14 is fully opened or fully closed, via the force provided by the spring 44 (shown in FIG. 11*b*). As the blade 14 rotates between the open and closed positions, the front of the wedge 42 rides along the exterior of the tang 26 until it is either driven into the slot 90 when the blade 14 is in the fully closed position or into the position shown in FIG. 11*b* when the blade 14 is fully opened.

Figure 12A:
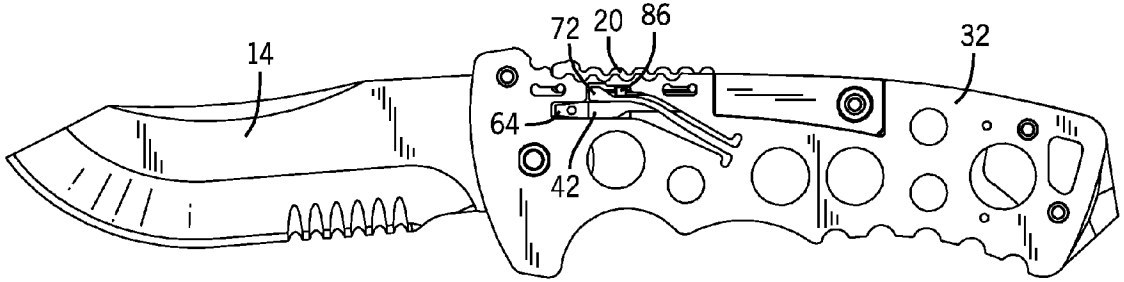
FIG. 12*a* is a side-view of a folding knife with the blade opened and locked and the safety off with the handle scale in the foreground removed according to an exemplary embodiment.
Figure 12B:
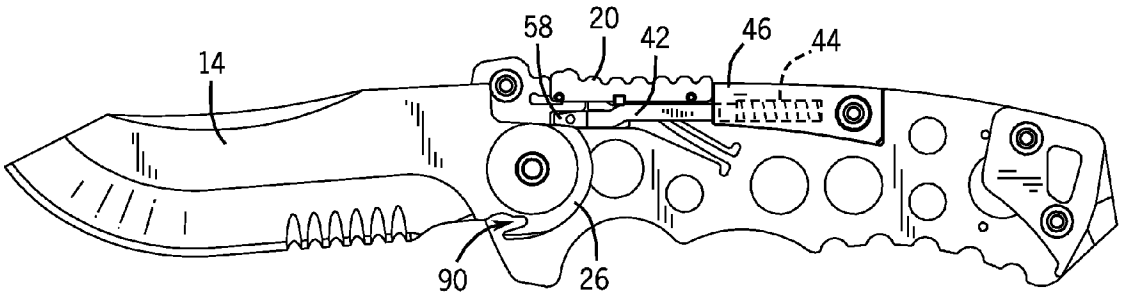
FIG. 12*b* is a side view of the folding knife of FIG. 12*a* with the liner in the foreground removed.

Referring to FIG. 12, the knife 10 is shown with the blade 14 open, the wedge 42 locked, with the safety 20 off. As described to with respect to FIG. 9, when the safety 20 is off, the spring arms 72 do not interfere with movement of the wedge 42 out of the locked position. In the configuration shown in FIG. 12 the blade 14 is still locked in the open position via the interface between the front portion 58 of the wedge 42 and the blade tang 26.

Figure 13A:
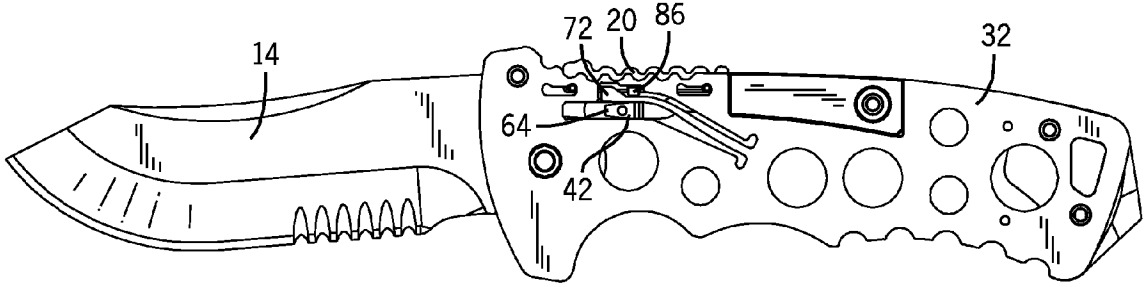
FIG. 13*a* is a side view of a folding knife with the blade opened and unlocked and the safety off with the handle scale in the foreground removed according to an exemplary embodiment.
Figure 13B:
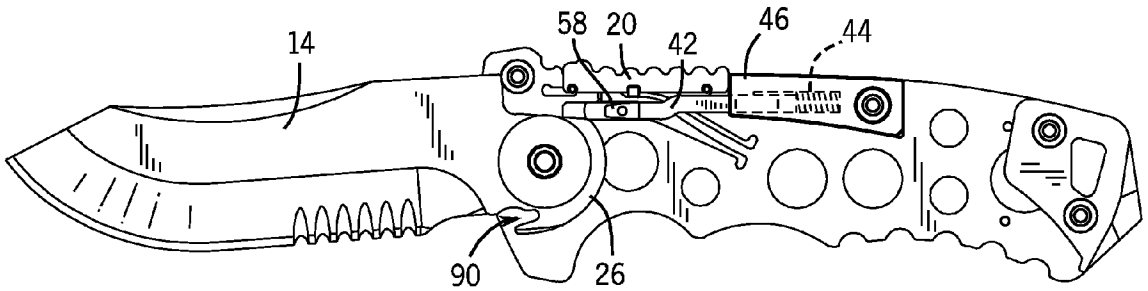
FIG. 13*b* is a side-view of the folding knife of FIG. 13*a* with the liner in the foreground removed.

Referring to FIG. 13, the knife 10 is shown with the blade 14 opened, the safety 20 off, and the wedge 42 in the unlocked position. The wedge 42 may be moved to the unlocked position by a user via grasping the lock buttons 18, 22 (see FIG. 3) and sliding the wedge 42 toward the rear end of the handle 12 against the force provided by the spring 44 (see FIG. 3). A user may only do so when the safety 20 is off, as shown in FIG. 13. Once the wedge 42 is moved to the unlocked position, the blade 14 may be rotated out of the open position toward the closed position by the user. In the case of an automatic knife 10, the user will rotate the blade 14 against the force provided by the blade spring 28. Once the blade 14 has been rotated a few degrees out of the open position, the user may release the lock buttons 18, 22 and the front of the wedge 42 will ride along the tang 26 until the blade 14 has reached the fully closed position when the spring 44 will force the wedge 42 back into a locked configuration in slot 90. In the embodiment shown in FIG. 13, the wedge 42 does not stay in the unlocked position unless held in the unlocked position against the force provided by the spring 44 (shown in FIG. 13*b*).

The construction and the arrangements of the examples shown in the figures and described herein are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, an automatic knife embodiment is shown in FIG. 3 but the safety mechanism and blade lock may be used in conjunction with an assisted-opening knife or a manual opening knife. Further, the positions of elements may be reversed or otherwise varied and the nature or number of discreet elements or positions may be altered or varied. Accordingly, all such modifications are intended to be included within the scope of the present application. Other substitutions, modifications, changes, and omissions may be made in the design, operating conditions, and arrangement of the exemplary embodiments without departing from the scope of the present application.

What is claimed is:

1. A folding knife, comprising:

a handle;

an axle coupled to a first end of the handle;

a blade rotatably coupled to the axle, the blade comprising a working portion and a tang, the blade having an open position in which the working portion extends from the handle and a closed position in which the working portion is substantially received within the handle;

a lock translatable along a path between a locked position in which the lock prevents rotation of the blade by contacting the tang and an unlocked position in which the lock permits rotation of the blade;

a spring arm in the handle, the spring arm movable between a first position and a second position, the spring arm biased to the second position; and a safety coupled to the handle, the safety movable between an on position in which the safety deflects the spring arm to the first position so that the spring arm blocks the path of the lock and maintains the lock in the locked position and an off position in which the safety permits the spring arm to move to the second position so that the lock is free to move between the locked position and the unlocked position.

2. The folding knife of claim 1, wherein the handle comprises a pair of liners and the spring arm is coupled to one of the liners.

3. The folding knife of claim 2, wherein the spring arm is integral with and extends from one of the liners.

4. The folding knife of claim 2, further comprising a second spring arm movable between a first position and a second position, the second spring arm biased to the second position, and the second spring arm coupled to the other of the liners, wherein the safety deflects the second spring arm to the first position so that the second spring arm blocks the path of the lock and maintains the lock in the locked position when the safety is in the on position.

5. The folding knife of claim 1, wherein the lock comprises a rear portion and a front portion, the front portion configured to interface with the tang to prevent rotation of the blade when the lock is in the locked position, and wherein the front portion is formed as a wedge.

6. The folding knife of claim 5, wherein the lock further comprises a pair of arms, each of the arms extending in a direction parallel to the axle.

7. The folding knife of claim 6, further comprising a pair of side scales forming exterior sides of the handle, the side scales each forming a slot configured to receive a lock arm such that the lock arms are accessible by a user to move the lock from the locked position into the unlocked position.

8. The folding knife of claim 1, further comprising a lock spring coupled between the lock and the handle, wherein the lock spring biases the lock into the locked position.

9. The folding knife of claim 8, wherein the tang includes a locking surface and a locking slot;

wherein, with the blade in the open position, the lock spring biases the lock to the locked position so that the lock engages the locking surface to prevent the blade from rotating to the closed position; and wherein, with the blade in the closed position, the lock spring biases the lock to the locked position so that the lock is inserted into the locking slot to prevent the blade from rotating to the open position.

10. The folding knife of claim 9, wherein the locking surface and the locking slot are located on opposite sides of the tang.

11. The folding knife of claim 1, further comprising a spring operating on the blade to bias the blade into the open position, wherein when the lock is in the unlocked position, the spring rotates the blade from the closed into the open position.

12. An automatic knife, comprising:

a handle;

an axle coupled to a first end of the handle;

a blade rotatably coupled to the axle, the blade comprising a working portion and a tang, the blade having an open position in which the working portion extends from the handle and a closed position in which the working portion is substantially received within the handle;

a spring operating on the blade to bias the blade into the open position;

a lock movable along a path between a locked position in which the lock prevents rotation of the blade by contacting the tang and an unlocked position in which the lock permits rotation of the blade;

a spring arm in the handle, the spring arm biased to a position in which the spring arm is not in the path of the lock so that the lock is free to move between the locked position and the unlocked position; and a safety coupled to the handle, the safety having an on position in which the safety deflects the spring arm into the path of the lock to maintain the lock in the locked position and an off position in which the safety permits the spring arm to return to the position in which the lock is free to move between the locked position and the unlocked position;

wherein when the lock is in the unlocked position, the spring rotates the blade from the closed into the open position.

13. The automatic knife of claim 12, wherein the handle comprises a pair of liners and the spring arm is integral with and extends from one of the liners.

14. The automatic knife of claim 12, further comprising a second spring arm movable between a first position and a second position, the second spring arm biased to the second position, and the second spring arm coupled to the other of the liners, wherein the safety deflects the second spring arm to the first position so that the second spring arm blocks the path of the lock and maintains the lock in the locked position when the safety is in the on position.

15. The automatic knife of claim 12, wherein the lock comprises a rear portion and a front portion, the front portion configured to interface with the tang to prevent rotation of the blade when the lock is in the locked position, and wherein the front portion is formed as a wedge.

16. The automatic knife of claim 15, wherein the lock further comprises a pair of arms, each of the arms extending in a direction parallel to the axle.

17. The automatic knife of claim 16, further comprising a pair of side scales forming exterior sides of the handle, the side scales each forming a slot configured to receive a lock arm such that the lock arms are accessible by a user to move the lock from the locked position into the unlocked position.

18. The automatic knife of claim 17, further comprising a lock button attached to each of the lock arms, the lock buttons disposed on the exterior of the handle to permit a user to interface with the lock buttons.

19. The automatic knife of claim 12, further comprising a lock spring coupled between the lock and the handle, wherein the lock spring biases the lock into the locked position.

20. The automatic knife of claim 19, wherein the tang includes a locking surface and a locking slot, the locking surface and the locking slot located on opposite sides of the tang;

wherein, with the blade in the open position, the lock spring biases the lock to the locked position so that the lock engages the locking surface to prevent the blade from rotating to the closed position; and wherein, with the blade in the closed position, the lock spring biases the lock to the locked position so that the lock is inserted into the locking slot to prevent the blade from rotating to the open position.

21. The automatic knife of claim 12, wherein the safety comprises a user interface accessible along a portion of the handle permitting a user to slide the safety between the first and second positions.

* * * * *